US009767762B2

(12) United States Patent
Miura

(10) Patent No.: US 9,767,762 B2
(45) Date of Patent: Sep. 19, 2017

(54) DRIVING METHOD FOR USE BY A DRIVER, DRIVER, ELECTROOPTICAL DEVICE, AND ELECTRONIC APPARATUS

(71) Applicant: SEIKO EPSON CORPORATION, Tokyo (JP)

(72) Inventor: Masahiko Miura, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 224 days.

(21) Appl. No.: 14/664,295

(22) Filed: Mar. 20, 2015

(65) Prior Publication Data

US 2015/0279316 A1 Oct. 1, 2015

(30) Foreign Application Priority Data

Mar. 26, 2014 (JP) ..... 2014-063127

(51) Int. Cl.
*G09G 5/10* (2006.01)
*G09G 5/02* (2006.01)
(Continued)

(52) U.S. Cl.
CPC ..... *G09G 5/02* (2013.01); *G09G 3/20* (2013.01); *G09G 3/30* (2013.01); *G09G 3/3611* (2013.01);
(Continued)

(58) Field of Classification Search
CPC .. G09G 5/02; G09G 5/18; G09G 3/20; G09G 3/30; G09G 3/3611; G09G 2310/0202; G09G 2340/08; G09G 2370/08
See application file for complete search history.

(56) References Cited

U.S. PATENT DOCUMENTS 5,831,374 A 11/1998 Morita et al.
6,069,674 A * 5/2000 Aomori ..... G02F 1/13318 345/81
(Continued)

FOREIGN PATENT DOCUMENTS

JP H09-199040 A 7/1997
JP H11-045072 A 2/1999
(Continued)

*Primary Examiner* — Peter D McLoone
(74) *Attorney, Agent, or Firm* — Oliff PLC

(57) ABSTRACT

In the 1$^{st}$ case, which is the case of driving a color display panel, pieces of color image data corresponding to 1$^{st}$ to 3$^{rd}$ colors are received in parallel, and in a horizontal scan period, pixels connected to i$^{th}$ to (i+2)$^{th}$ gate lines from among 1$^{st}$ to n$^{th}$ gate lines are driven according to the pieces of color image data corresponding to the 1$^{st}$ to 3$^{rd}$ colors. In the 2$^{nd}$ case, which is the case of driving a monochrome display panel, pieces of monochrome image data (DM1[7:0] to DM3[7:0]) for three horizontal scan lines are received in parallel, and in a horizontal scan period, pixels connected to j$^{th}$ to (j+2)$^{th}$ gate lines from among 1$^{st}$ to m$^{th}$ gate lines (gate lines G1 to G960) are driven according to the pieces of monochrome image data (DM1[7:0] to DM3[7:0]).

20 Claims, 13 Drawing Sheets

(51) Int. Cl.

| | |
|---|---|
| ***G09G 3/30*** | (2006.01) |
| ***G09G 3/36*** | (2006.01) |
| ***G09G 5/18*** | (2006.01) |
| ***G09G 3/20*** | (2006.01) |

(52) U.S. Cl.
CPC ..... *G09G 5/18* (2013.01); *G09G 2310/0202* (2013.01); *G09G 2340/08* (2013.01); *G09G 2370/08* (2013.01)

(56) References Cited

U.S. PATENT DOCUMENTS

| | | | | |
|---|---|---|---|---|
| 9,330,782 | B2 * | 5/2016 | Yamamoto | G11C 19/28 |
| 2001/0050688 | A1 | 12/2001 | Fujiyoshi et al. | |
| 2002/0163490 | A1 | 11/2002 | Nose | |
| 2009/0244441 | A1 * | 10/2009 | Nagato | G02F 1/13475 349/78 |
| 2013/0100007 | A1 * | 4/2013 | Yamamoto | G09G 3/3677 345/100 |
| 2013/0120465 | A1 * | 5/2013 | Govil | G09G 3/2074 345/690 |
| 2013/0141454 | A1 * | 6/2013 | Park | G09G 5/02 345/589 |
| 2017/0076692 | A1 * | 3/2017 | Miura | G09G 3/3685 |

FOREIGN PATENT DOCUMENTS

| | | | |
|---|---|---|---|
| JP | 2002-333863 | A | 11/2002 |
| JP | 2005-134645 | A | 5/2005 |

* cited by examiner

DRIVING METHOD FOR USE BY A DRIVER, DRIVER, ELECTROOPTICAL DEVICE, AND ELECTRONIC APPARATUS

CROSS-REFERENCE TO RELATED APPLICATIONS

This application claims priority to Japanese Patent Application No. 2014-063127 filed on Mar. 26, 2014.

The entire disclosure of Japanese Patent Application No. 2014-063127 is hereby incorporated herein by reference.

BACKGROUND

1. Technical Field

The present invention relates to a driving method for the use by a driver, a driver, an electro-optical device, and an electronic apparatus.

2. Related Art

A triple gate method is known as a method for driving a color display panel (e.g., JP-A-11-45072, JP-A-2002-333863, JP-A-9-199040). According to the triple gate method, display of one horizontal scan line is implemented by using a set of three gate lines corresponding to RGB. To the three gate lines, three gate driving terminals of a driver are connected. The driver performs RGB display by driving the three gate lines via the three gate driving terminals in each horizontal scan period.

According to known methods, when the above-described color display driver is used for driving a monochrome display panel, one gate line is driven by using one of the three gate driving terminals corresponding to RGB. In a monochrome display panel, one gate line corresponds to one horizontal scan line, and accordingly the maximum number of horizontal scan lines that can be driven is the same as in the case of driving a color display panel.

In this way, known methods have the problem that the size (i.e. the number of the horizontal scan lines) of a monochrome display panel that can be driven is at most the same as the size of a color display panel.

SUMMARY

An advantage of some aspects of the invention is to provide a driving method for the use by a driver, a driver, an electro-optical device, and an electronic apparatus, and the likes that are capable of driving a monochrome display panel that is greater in size than a color display panel.

One aspect of the invention relates to a driving method for use by a driver. The driving method includes: in a $1^{st}$ case, which is a case of driving a color display panel in which one horizontal scan line is composed of three gate lines corresponding to $1^{st}$ to $3^{rd}$ colors, receiving pieces of image data corresponding to the $1^{st}$ to $3^{rd}$ colors in parallel; and in a horizontal scan period, driving pixels connected to $i^{th}$ to $(i+2)^{th}$ gate lines corresponding to the horizontal scan period from among $1^{st}$ to $n^{th}$ gate lines of the color display panel according to the pieces of color image data corresponding to the $1^{st}$ to $3^{rd}$ colors, where n is a natural number no less than 3, and i=1, 4, 7, . . . , n−2, and in a $2^{nd}$ case, which is a case of driving a monochrome display panel in which one horizontal scan line is composed of one gate line, receiving pieces of monochrome image data for three horizontal scan lines in parallel; and in a horizontal scan period, driving pixels connected to $j^{th}$ to $(j+2)^{th}$ gate lines corresponding to the horizontal scan period from among $1^{st}$ to $m^{th}$ gate lines of the monochrome display panel according to the pieces of monochrome image data for the three horizontal scan lines of the monochrome display panel, where m is a natural number no less than 3, and j=1, 4, 7, . . . , m−2.

According to the aspect of the invention, in the case of the driving of a monochrome display panel, pixels connected to $j^{th}$ to $(j+2)^{th}$ gate lines are driven in one horizontal scan period. Thus, pixels connected to three horizontal scan lines are driven in each horizontal scan period, and a monochrome display panel that is greater in size than a color display panel can be driven.

Also, in the aspect of the invention, in the $2^{nd}$ case, which is the case of driving the monochrome display panel, in the horizontal scan period, the $j^{th}$ to $(j+2)^{th}$ gate lines may be sequentially selected, and source lines of the monochrome display panel may be sequentially driven according to the respective pieces of monochrome image data for $1^{st}$ to $3^{rd}$ horizontal lines from among the three horizontal scan lines.

According to known driving methods, one horizontal scan line is displayed in each horizontal scan period, and therefore the number of the horizontal scan lines of a monochrome display panel that can be driven is at most the same as the number of the horizontal scan lines of a color display panel. In contrast, according to the aspect of the invention, three gate lines are sequentially selected in each horizontal scan period, and thus three horizontal scan lines are sequentially displayed. In this way, compared to known driving methods, a monochrome display panel having three times the number of horizontal scan lines can be driven.

Also, in the aspect of the invention, in the $1^{st}$ case, which is the case of driving the color display panel, in the horizontal scan period, the $i^{th}$ to $(i+2)^{th}$ gate lines may be sequentially selected, and source lines of the color display panel may be sequentially driven according to the respective pieces of color image data corresponding to the $1^{st}$ to $3^{rd}$ colors.

In this way, in the case of the driving of a color display panel, one horizontal scan line is displayed in each horizontal scan period. In contrast, according to the aspect of the invention, in the $2^{nd}$ case, three horizontal scan lines are sequentially displayed in each horizontal scan period, and accordingly a monochrome display panel having three times the number of horizontal scan lines as a color display panel can be driven.

Also, in the aspect of the invention, the driving method may further include: setting one of $1^{st}$ to $3^{rd}$ modes; when the $1^{st}$ mode is set, performing operation for the $1^{st}$ case, which is the case of driving the color display panel; when the $2^{nd}$ mode is set, performing operation for the $2^{nd}$ case, which is the case of driving the monochrome display panel; and when the $3^{rd}$ mode is set, receiving monochrome image data for one horizontal scan line, and in a horizontal scan period, driving pixels connected to a $k^{th}$ gate line from among the $1^{st}$ to $m^{th}$ gate lines of the monochrome display panel according to the monochrome image data for the one horizontal scan line, where k is a natural number no greater than m.

According to this method, a mode that is suitable for the display panel can be selected. Also, in the case of the driving of a monochrome display panel, it is possible to switch between the mode of driving one horizontal scan line in each horizontal scan period and the mode of driving three horizontal scan lines in each horizontal scan period.

Also, in the aspect of the invention, the $1^{st}$ to $3^{rd}$ modes may be set according to a voltage level that is set to a mode setting terminal, or a mode setting command that is received from a host controller.

According to this method, the $1^{st}$ to $3^{rd}$ modes are set according to the voltage level set to the mode setting terminal or the mode setting command issued by the host controller.

Also, in the aspect of the invention, in the $2^{nd}$ case, which is the case of driving the monochrome display panel, $1^{st}$ to $m^{th}$ gate drive signals from among $1^{st}$ to $p^{th}$ gate drive signals may be output to the $1^{st}$ to $m^{th}$ gate lines, where p is a natural number no less than m, and m>p/3.

As in the $3^{rd}$ mode, in the case of displaying one horizontal scan line in each horizontal scan period, m≤p/3 is satisfied and this is the same as in the $1^{st}$ case, which is the case of driving the color display panel. In contrast, in the $2^{nd}$ case, three horizontal scan lines are displayed in each horizontal scan period, and m>p/3 is satisfied. Therefore, a monochrome display panel having a greater number of horizontal scan lines than a color display panel can be driven.

Another aspect of the invention relates to a driver including: a gate driver; a source driver; and a control circuit that controls the gate driver and the source driver. In a $1^{st}$ case, which is a case of driving a color display panel in which one horizontal scan line is composed of three gate lines corresponding to $1^{st}$ to $3^{rd}$ colors: the control circuit receives pieces of color image data corresponding to the $1^{st}$ to $3^{rd}$ colors in parallel; the gate driver, in a horizontal scan period, drives $i^{th}$ to $(i+2)^{th}$ gate lines corresponding to the horizontal scan period from among $1^{st}$ to $n^{th}$ gate lines of the color display panel, where n is a natural number no less than 3, and i=1, 4, 7, . . . n−2; and the source driver, in the horizontal scan period, drives pixels connected to the $i^{th}$ to $(i+2)^{th}$ gate lines according to the pieces of color image data corresponding to the $1^{st}$ to $3^{rd}$ colors. In a $2^{nd}$ case, which is a case of driving a monochrome display panel in which one horizontal scan line is composed of one gate line: the control circuit receives pieces of monochrome image data for three horizontal scan lines in parallel; the gate driver, in the horizontal scan period, drives $j^{th}$ to $(j+2)^{th}$ gate lines corresponding to the horizontal scan period from among $1^{st}$ to $m^{th}$ gate lines of the monochrome display panel, where m is a natural number no less than 3, and j=1, 4, 7, . . . , m−2; and the source driver, in the horizontal scan period, drives pixels connected to the $j^{th}$ to $(j+2)^{th}$ gate lines according to the pieces of monochrome image data for the three horizontal scan lines.

According to this aspect of the invention, in the case of driving a monochrome display panel, pixels connected to the $j^{th}$ to $(j+2)^{th}$ gate lines are driven by the gate driver and the source driver in each horizontal scan period. Thus, pixels connected to three horizontal scan lines are driven in each horizontal scan period, and a monochrome display panel that is greater in size than a color display panel can be driven.

Also, in the aspect of the invention, the control circuit may set one of $1^{st}$ to $3^{rd}$ modes. When the $1^{st}$ mode is set, the control circuit, the gate driver, and the source driver may perform operation for the $1^{st}$ case, which is the case of driving the color display panel. When the $2^{nd}$ mode is set, the control circuit, the gate driver, and the source driver may perform operation for the $2^{nd}$ case, which is the case of driving the monochrome display panel. When the $3^{rd}$ mode is set, the control circuit may receive monochrome image data for one horizontal scan line, the gate driver, in a horizontal scan period, may drive a $k^{th}$ gate line from among the $1^{st}$ to $m^{th}$ gate lines of the monochrome display panel, where k is a natural number no greater than m, and the source driver, in the horizontal scan period, may drive pixels connected to the $k^{th}$ gate line according to the monochrome image data for the one horizontal scan line.

Also, in the aspect of the invention, the control circuit may set the $1^{st}$ to $3^{rd}$ modes according to a voltage level that is set to a mode setting terminal, or a mode setting command that is received from a host controller.

Also, in the aspect of the invention, in the $2^{nd}$ case, which is the case of driving the monochrome display panel, the gate driver may sequentially select the $j^{th}$ to $(j+2)^{th}$ gate lines in the horizontal scan period, and the source driver may sequentially drive source lines of the monochrome display panel according to the respective pieces of monochrome image data for $1^{st}$ to $3^{rd}$ horizontal scan lines from among the three horizontal scan lines.

Also, in the aspect of the invention, in the $1^{st}$ case, which is the case of driving the color display panel, the gate driver may sequentially select the $i^{th}$ to $(i+2)^{th}$ gate lines, and the source driver may sequentially drive source lines of the color display panel according to the respective pieces of color image data corresponding to the $1^{st}$ to $3^{rd}$ colors.

Also, in the aspect of the invention, in the $2^{nd}$ case, which is the case of driving the monochrome display panel, the gate driver may output $1^{st}$ to $m^{th}$ gate drive signals from among $1^{st}$ to $p^{th}$ gate drive signals to the $1^{st}$ to $m^{th}$ gate lines, where p is a natural number no less than m, and m>p/3.

Yet another aspect of the invention relates to an electro-optical device including any of the above-described drivers, and the color display panel or the monochrome display panel.

Yet another aspect of the invention relates to an electronic device including any of the above-described drivers.

BRIEF DESCRIPTION OF THE DRAWINGS

The invention will be described with reference to the accompanying drawings, wherein like numbers reference like elements.

DESCRIPTION OF EXEMPLARY EMBODIMENTS

The following describes embodiments of the invention in detail with reference to the drawings. It should be noted that the embodiments described below are not intended to unreasonably limit the contents of the invention described in the attached claims. Furthermore, not all configurations described below are constituent elements indispensable for achieving the advantage of the invention.

1. Display Panel

The following describes an example case where a driver according to an embodiment of the invention sets a different driving mode depending on the display panel. However, the invention should not be limited to this case. For example, it is not essential to set the $1^{st}$ mode and the $2^{nd}$ mode.

First, a description is given to a display panel driven by a driver according to the embodiment. Examples of the display panel adoptable here include an active matrix liquid crystal display panel (e.g., TFT liquid crystal display panel) and a display panel using self-luminous elements (e.g., EL elements).

Figure 1:
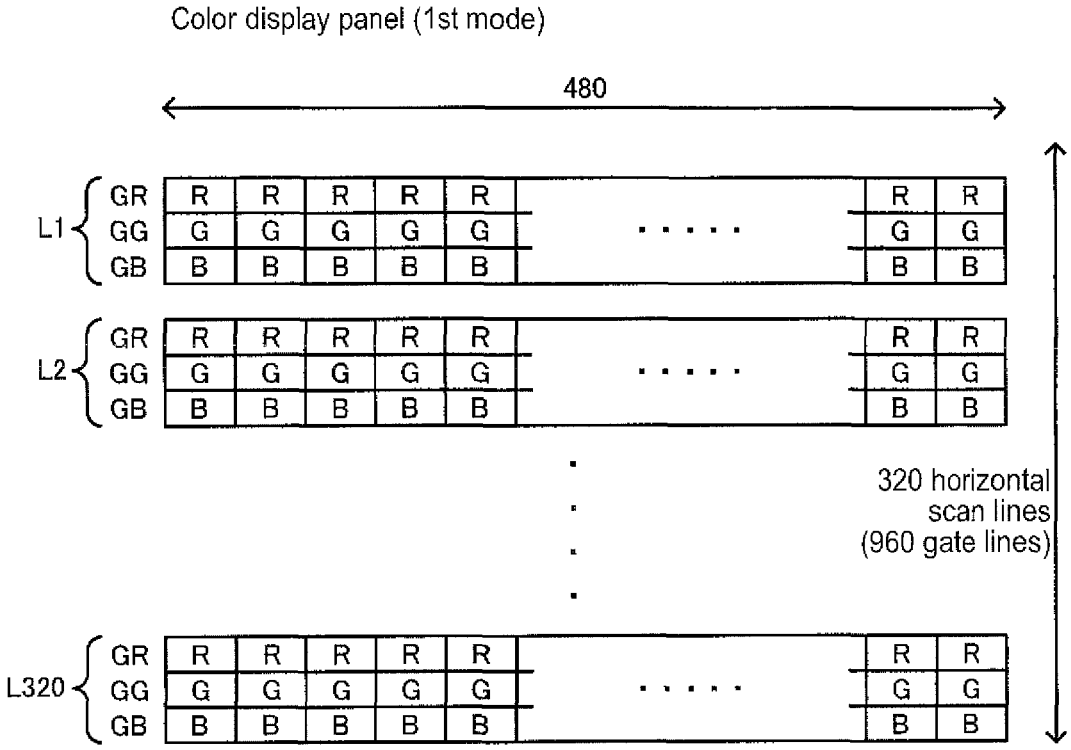
FIG. 1 shows an example of the configuration of a color display panel driven in the $1^{st}$ mode.

FIG. 1 is an example of the configuration of a color display panel driven in the $1^{st}$ mode. The size of the color display panel is 480×320, where the size in the vertical direction is represented by the number of the horizontal scan lines. In other words, the color display panel includes 480 source lines and 320 horizontal scan lines (horizontal scan lines L1 to L320). One horizontal scan line is composed of three gate lines (gate lines GR, GG, and GB). Red (R) pixels are connected to the intersections of the gate line GR and the source lines. Green (G) pixels are connected to the intersections of the gate line GG and the source lines. Blue (B) pixels are connected to the intersections of the gate line GB and the source lines. The number of the gate lines is 320×3=960.

In the embodiment, in the case of color display, three pixels, namely R, G, and B pixels, are arranged in the vertical direction and constitute the minimum unit in a display image, whereas, in the case of monochrome display, one pixel constitutes the minimum unit in a display image. Here, one horizontal scan line is defined as a line for scanning one row of the minimum units arranged in the horizontal direction. Accordingly, in a color display panel, one horizontal scan line is composed of three gate lines, i.e., gate lines GR, GG and GB. In a monochrome display panel, one horizontal scan line is composed of one gate line.

Figure 2:
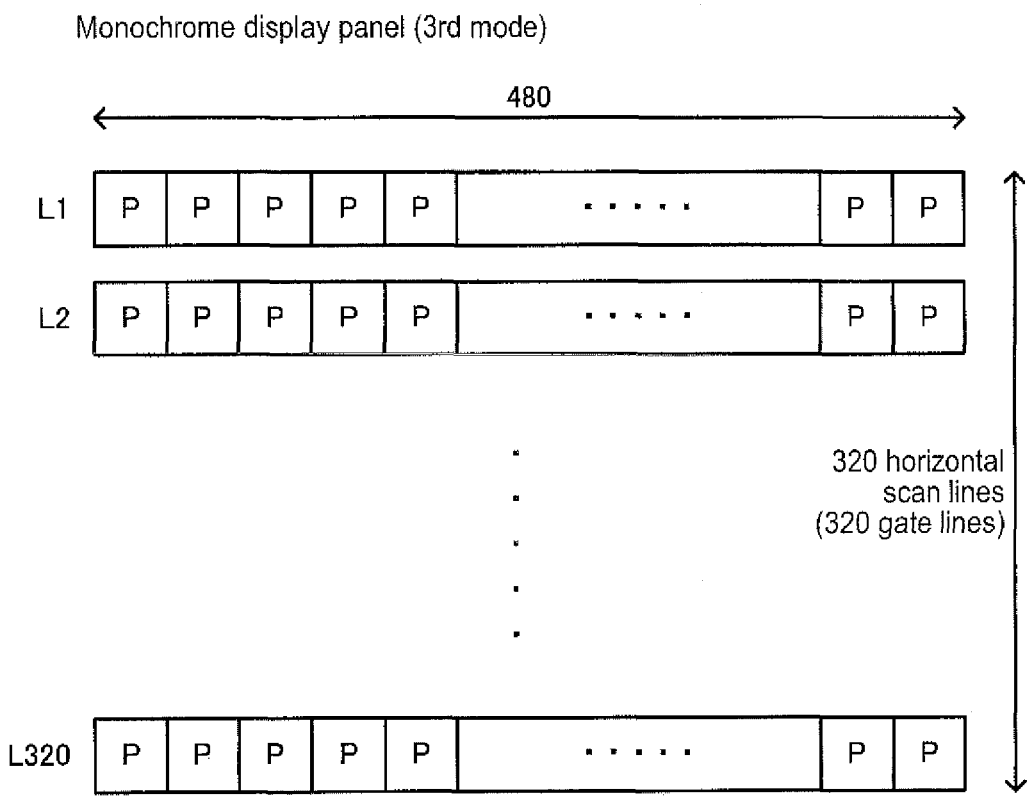
FIG. 2 shows an example of the configuration of a monochrome display panel driven in the $3^{rd}$ mode.

FIG. 2 shows an example of the configuration of a monochrome display panel driven in the $3^{rd}$ mode. The monochrome display panel has a size of 480×320, which is the same as the color display panel shown in FIG. 1. In other words, the monochrome display panel includes 480 source lines and 320 horizontal scan lines (scan lines L1 to L320). One horizontal scan line is composed of one gate line. Monochrome pixels (P) are connected to the intersections of the gate lines and the source lines.

The $3^{rd}$ mode is a mode for using the driver for the color display panel shown in FIG. 1 as a substitute for the driver for a monochrome display panel. As described below, the size of a monochrome display panel that can be driven in the $3^{rd}$ mode is at most the same as a color display panel. For example, suppose a driver that can switch only between the $1^{st}$ mode and the $3^{rd}$ mode is given as a comparative example. This driver cannot be connected to a monochrome display panel that has a size greater than 480×320 (in terms of the number of horizontal scan lines). For this reason, the driver according to the embodiment is provided with the $2^{nd}$ mode for driving the monochrome display panel, as described below.

Figure 3:
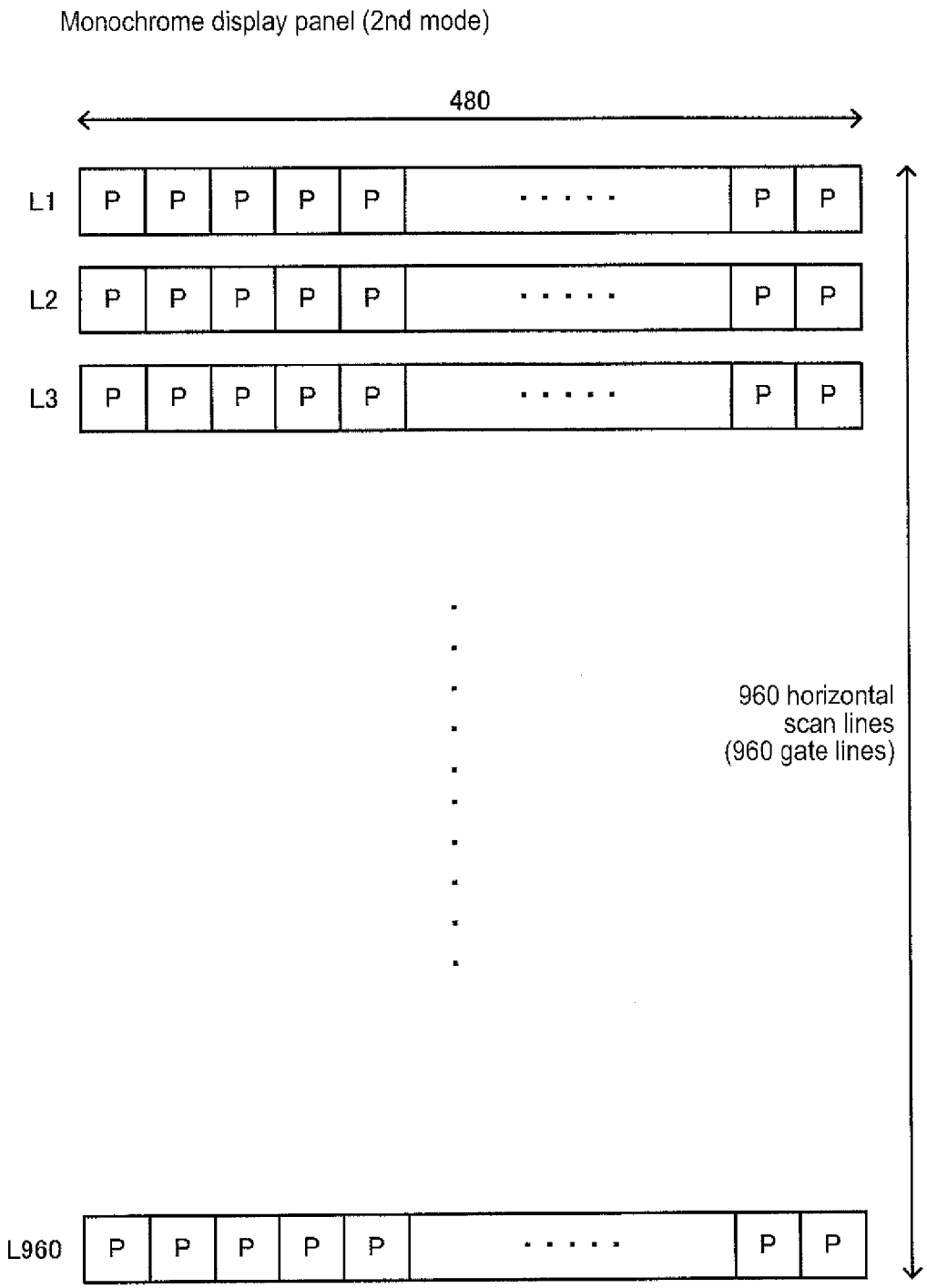
FIG. 3 shows an example of the configuration of a monochrome display panel driven in the $2^{nd}$ mode.

FIG. 3 shows an example of the configuration of a monochrome display panel driven in the $3^{rd}$ mode. The monochrome display panel has a size of 480×960, with three times the number of horizontal scan lines as the color display panel shown in FIG. 1. In other words, the monochrome display panel includes 480 source lines and 960 horizontal scan lines (horizontal scan lines L1 to L960). One horizontal scan line is composed of one gate line. Monochrome pixels (P) are connected to the intersections of the gate lines and the source lines.

The driver according to the embodiment can drive such a monochrome display panel, which is greater in size than a color display panel. This is achieved by the $2^{nd}$ mode in which three horizontal scan lines are driven in each horizontal scan period. The following provides detailed description of an example configuration of the connection between the driver and the display panel and operation of the driver, with respect to each mode. Note that although the driver according to the embodiment can switch among the $1^{st}$ to $3^{rd}$ modes, the driver, after being installed in a display panel, basically operates in one fixed mode that is suitable for the display panel. (The mode is determined by, for example, the settings of the terminals described below.)

2. Driver 2.1. $1^{st}$ Mode

Figure 4:
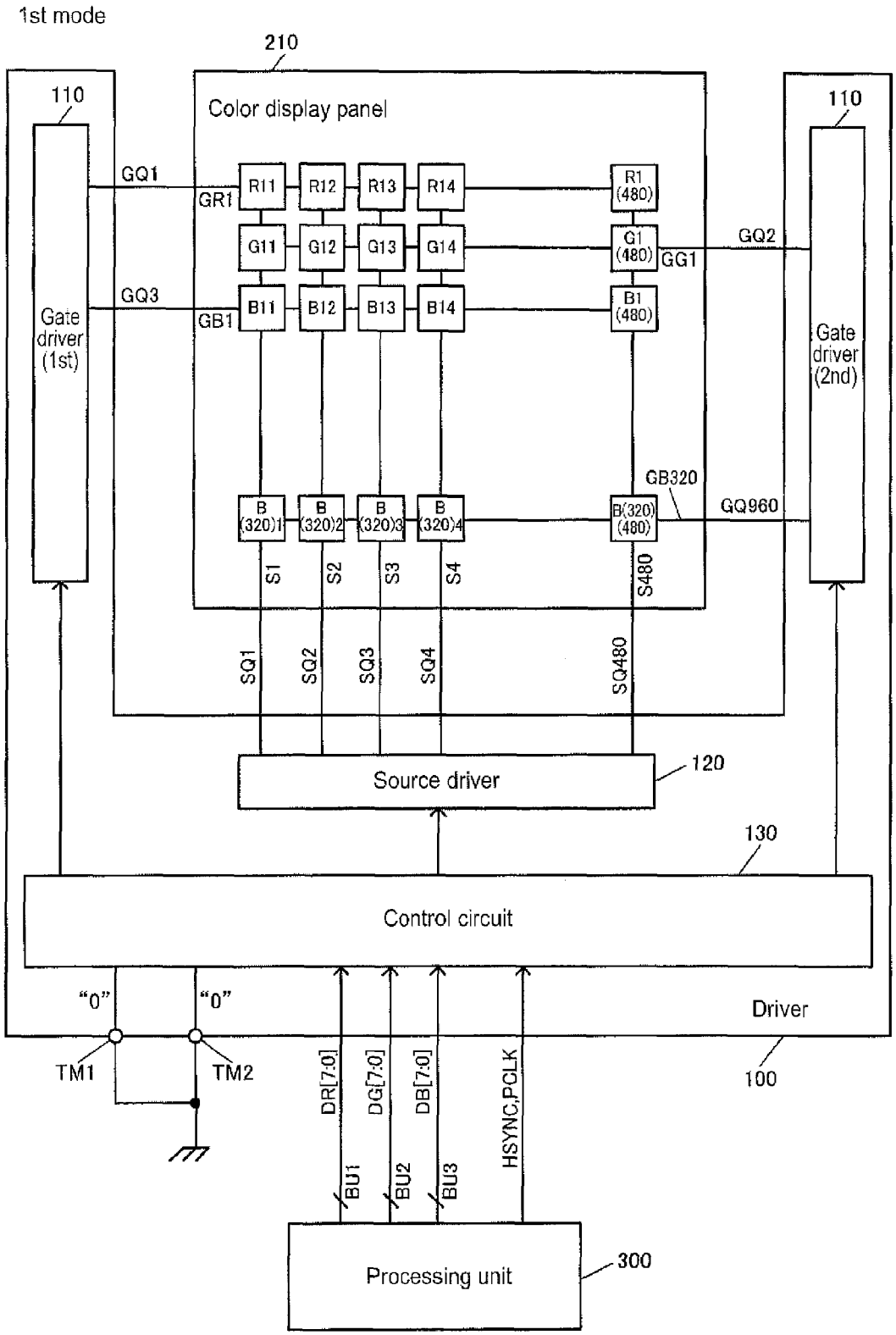
FIG. 4 shows an example of the configuration of a driver according to an embodiment, and an example of the connection configuration of the driver in the $1^{st}$ mode.

FIG. 4 shows an example of the configuration of the driver according to the embodiment, and the connection configuration of the driver in the $1^{st}$ mode (the $1^{st}$ case), which is the mode of driving the color display panel shown in FIG. 1.

The driver 100 includes a gate driver 110, a source driver 120, and a control circuit 130. The driver 100 is configured as, for example, an integrated circuit (IC) device. Although the following describes a case of driving a display panel by using a single IC chip, the invention should not be limited to this case. For example, 480 source lines may be driven by two IC chips, 240 lines for each.

The gate driver 110 is a circuit for driving the gate lines of the display panel. The gate driver outputs $1^{st}$ to $960^{th}$ gate drive signals (gate drive signals GQ1 to GQ960), thereby driving the 960 gate lines of a color display panel 210. Specifically, the gate driver 110 includes a $1^{st}$ gate driver and a $2^{nd}$ gate driver. The $1^{st}$ gate driver drives, from among the 960 gate lines, the gate lines GR1, GB1, GG2, . . . , and GG320, which are the odd-numbered gate lines. The $2^{nd}$ gate driver drives, from among the 960 gate lines, the gate line GG1, GR2, GB2, . . . , GB320, which are the even-numbered gate lines.

The source driver 120 is a circuit for driving the source lines of a display panel. The source driver 120 outputs $1^{st}$ to $480^{th}$ source drive signals (source drive signals SQ1 to SQ480). (The source drive signals may be referred to as source voltages or data voltages). The source driver 120 thereby drives the $1^{st}$ to $480^{th}$ source lines (source lines S1 to S480) of the color display panel 210. In the case of the driving by time division multiplexing, the number of the source drive signals to be output equals to the number of the source lines divided by the number of the channels for multiplexing. If this is the case, the color display panel 210 includes a demultiplexer for distributing the multiplexed source drive signals.

In the color display panel 210, as described above for FIG. 1, one horizontal scan line is composed of three gate lines corresponding to the $1^{st}$ to $3^{rd}$ color (i.e., RGB colors). In FIG. 4, pixels connected to the $1^{st}$ source line S1 and the RGB gate lines constituting the $1^{st}$ horizontal scan line, namely the gate lines GR1, GG1, and GB1, are referred to as pixels R11, G11, and B11. For example, when the gate driver 110 activates the gate drive signal GQ1, the source drive signals SQ1 to SQ480 are written into the pixels R11 to R1(480) connected to the gate line GR1.

The control circuit 130 controls the gate driver 110 and the source driver 120 according to pieces of image data and control signals received from a processing unit 300 (host controller). Specifically, the processing unit 300 outputs pieces of RGB color image data DR[7:0], DG[7:0], and DB[7:0] to the $1^{st}$ bus BU1, the $2^{nd}$ bus BU2, and the $3^{rd}$ bus BU3, respectively. Each piece of gradation data corresponding to one color has 8 bits per pixel for example, and 24 bits for the RGB colors in total. The control circuit 130 receives the pieces of image data (24 bits in total) in parallel. The processing unit 300 also outputs, to the control circuit 130, a synchronization signal such as a horizontal synchronization signal HSYNC, and a clock signal PCLK that is in synchronization with the image data.

Based on the pieces of image data and the control signals described above, the control circuit 130 outputs address signals to the gate driver 110, and outputs the pieces of image data corresponding to the source lines to the source driver 120. The gate driver 110 decodes a received address signal, and selects a gate line corresponding to the value obtained by the decoding. The source driver 120 performs D/A conversion to covert a received piece of image data to a gradation voltage (data voltage), subjects the gradation voltage to buffering by a source amplifier (not depicted in the drawing), and outputs the resulting voltage as a source drive signal.

In the $1^{st}$ mode, the gate driver 110 drives $i^{th}$ to $(i+2^{th})$ gate lines corresponding to the RGB colors in each horizontal scan period (i changes for each horizontal scan period in the following manner: 1, 4, 7, . . . , 958). In each horizontal scan period, the source driver 120 drives the pixels connected to the $i^{th}$ to $(i+2)^{th}$ gate lines according to the pieces of RGB color image data DR[7:0], DG[7:0], and DB[7:0]. For example, in the $1^{st}$ horizontal scan period for driving the $1^{st}$ horizontal scan line, the $1^{st}$ to $3^{rd}$ gate lines (gate lines GR1, GG1, and GB1) are selected (i=1). Then, the gradation voltages corresponding to the pieces of image data DR[7:0], DG[7:0], and DB[7:0] are written into the pixels R11 to R1(480), G11 to G1(480), and B11 to B1(480), respectively.

As described above, in the $1^{st}$ mode, the graduation voltages are written into the pixels connected to the three gate lines corresponding to the RGB colors in each horizontal scan period. Therefore, one horizontal scan line of the color display panel 210 can be rendered in each horizontal scan line, and accordingly, a one-frame image can be displayed by performing this rendering 320 times in the vertical scan period.

In the description above, it is assumed that the number of the outputs from the driver 100 is the same as the size (i.e. the number of the horizontal scan lines) of the color display panel 210. However, the invention should not be limited in this way. In other words, the color display panel 210 may have $1^{st}$ to $n^{th}$ gate lines (n is a natural number no less than 3) and $1^{st}$ to $q^{th}$ source lines. If this is the case, the size of the panel is q×(n/3). The gate driver 110 may output $1^{st}$ to $p^{th}$ gate drive signals (p≥1), among which $1^{st}$ to $n^{th}$ gate drive signals may drive $1^{st}$ to $n^{th}$ gate lines. In the example shown in FIG. 4, n=p=960 and q=480.

2.2. $3^{rd}$ Mode

Figure 5:
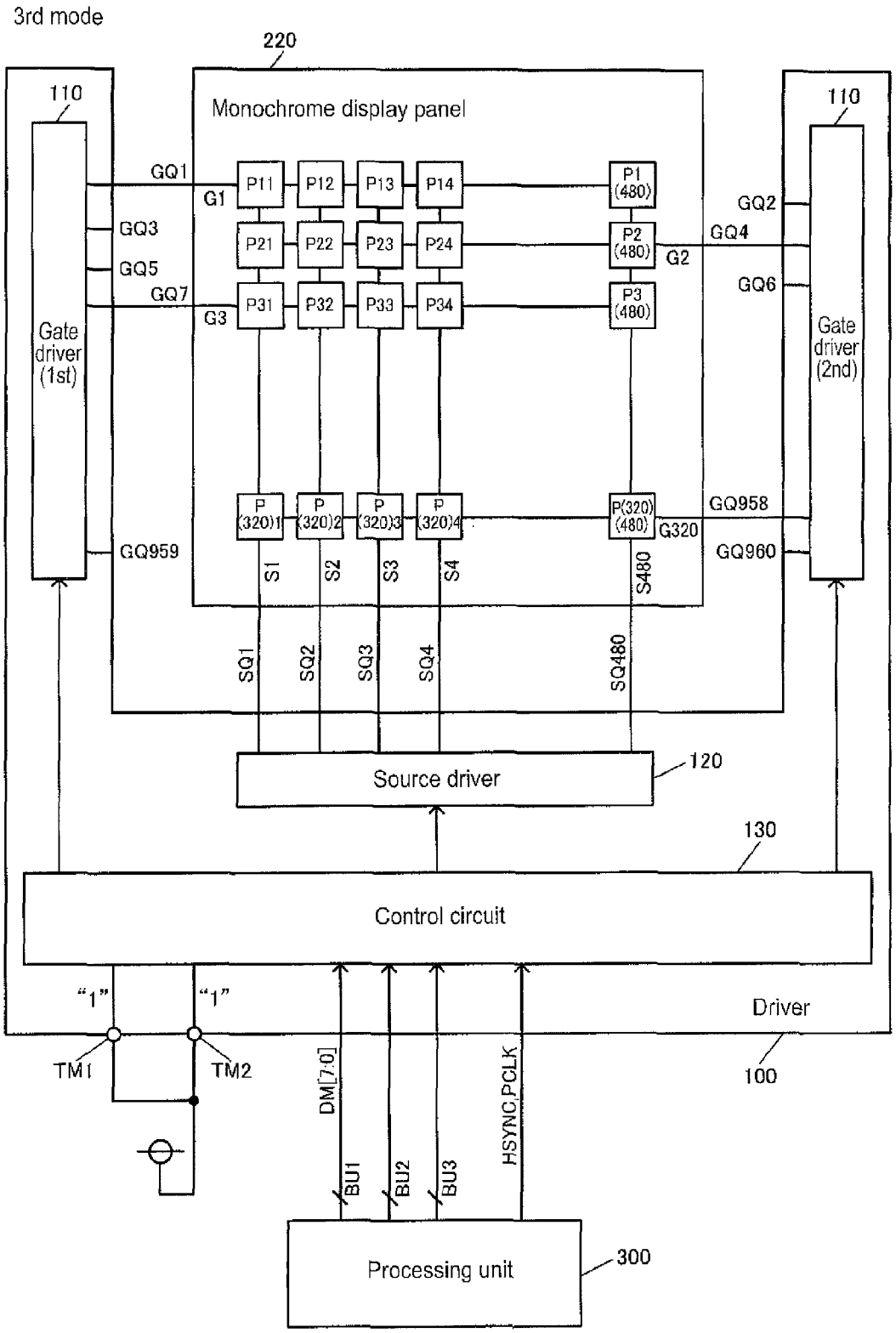
FIG. 5 shows an example of the connection configuration of the driver in the $3^{rd}$ mode.

FIG. 5 shows an example of the connection configuration of the driver in the $3^{rd}$ mode for driving the monochrome display panel shown in FIG. 2. Note that elements that are the same as elements already described above are indicated by the same reference signs, and explanation thereof is omitted.

The gate driver 110 drives 320 gate lines of the monochrome display panel 220 by using ⅓ of the $1^{st}$ drive to $960^{th}$ gate drive signals (gate drive signals GQ1 to GQ960). Specifically, the gate driver 110 uses, from among three types of gate drive signals used in the $1^{st}$ mode, which correspond to the RGB colors for color display, one type of gate drive signals, which corresponds to one of the RGB colors (e.g., R color). In other words, the driver 110 outputs gate drive signals GQ1, GQ4, GQ7, . . . , GQ958 to the $1^{st}$ to the $320^{th}$ gate lines (the gate lines G1 to G320), respectively.

As described above with reference to FIG. 2, the monochrome display panel 220 is a panel in which one horizontal scan line is composed of one gate line. In FIG. 5, the pixel connected to the $1^{st}$ gate line G1 and the $1^{st}$ source line S1 is indicated by reference sign P11. For example, when the gate driver 110 activates the gate drive signal GQ1, the source drive signals SQ1 to SQ480 are written into the pixels P11 to P1(480) connected to the gate line G1.

The processing unit 300 outputs a piece of monochrome image data DM[7:0] to the $1^{st}$ bus BU1. The piece of gradation data has 8 bits per pixel for example. The processing unit 300 does not output image data to the $2^{nd}$ bus BU2 or the $3^{rd}$ bus BU3. In other words, the control circuit 130 receives the piece of image data (8 bits) from only one bus, namely the bus BU1.

In the $3^{rd}$ mode, the gate driver 110 drives a $k^{th}$ gate line Gk in each horizontal scan period (k changes for each horizontal scan period in the following manner: 1, 2, 3, . . . , 320). Then, in the horizontal scan period, the source driver 120 drives the pixels connected to the $k^{th}$ gate line Gk according to the monochrome image data DM[7:0] for one horizontal scan line. For example, in the $1^{st}$ horizontal scan period for driving the $1^{st}$ horizontal scan line, the $1^{st}$ gate line G1 (k=1) is selected. Then, the gradation voltages corresponding to the image data DM[7:0] are written into the pixels P11 to P1(480).

Here, suppose a comparative example of a driver that can switch only between the $1^{st}$ mode and the $3^{rd}$ mode. As described below, in the $1^{st}$ mode and the $3^{rd}$ mode, one horizontal scan line is rendered in one horizontal scan period. When such a driving method is used, both in the case of color display and in the case of monochrome display, the maximum size of a one-frame image is at most 480×320. That is, the driver as the comparative example cannot drive a monochrome display panel greater in size than 480×320, which is the maximum size of a color display panel.

In the description above, it is assumed that the number of the gate outputs from the driver 100 is three times the vertical size of the monochrome display panel 200. However, the invention should not be limited in this way. In other words, the monochrome display panel 220 may have $1^{st}$ to $m^{th}$ gate lines (m is a natural number no less than 3) and $1^{st}$ to $q^{th}$ source lines. If this is the case, the size of the panel is q×m. The gate driver 110 may drive the $1^{st}$ to $m^{th}$ gate lines by using m gate drive signals from among $1^{st}$ to $p^{th}$ gate drive signals (p/3≥m). In terms of the relationship with the $1^{st}$ to $n^{th}$ gate lines of the color display panel 210, p/3≥n/3≥m is satisfied. In the example shown in FIG. 5, m=n/3=p/3=320 and q=480 are satisfied.

2.3. $2^{nd}$ Mode

The following describes the $2^{nd}$ mode (the $2^{nd}$ case) that solves the problem of the comparative example described above.

Figure 6:
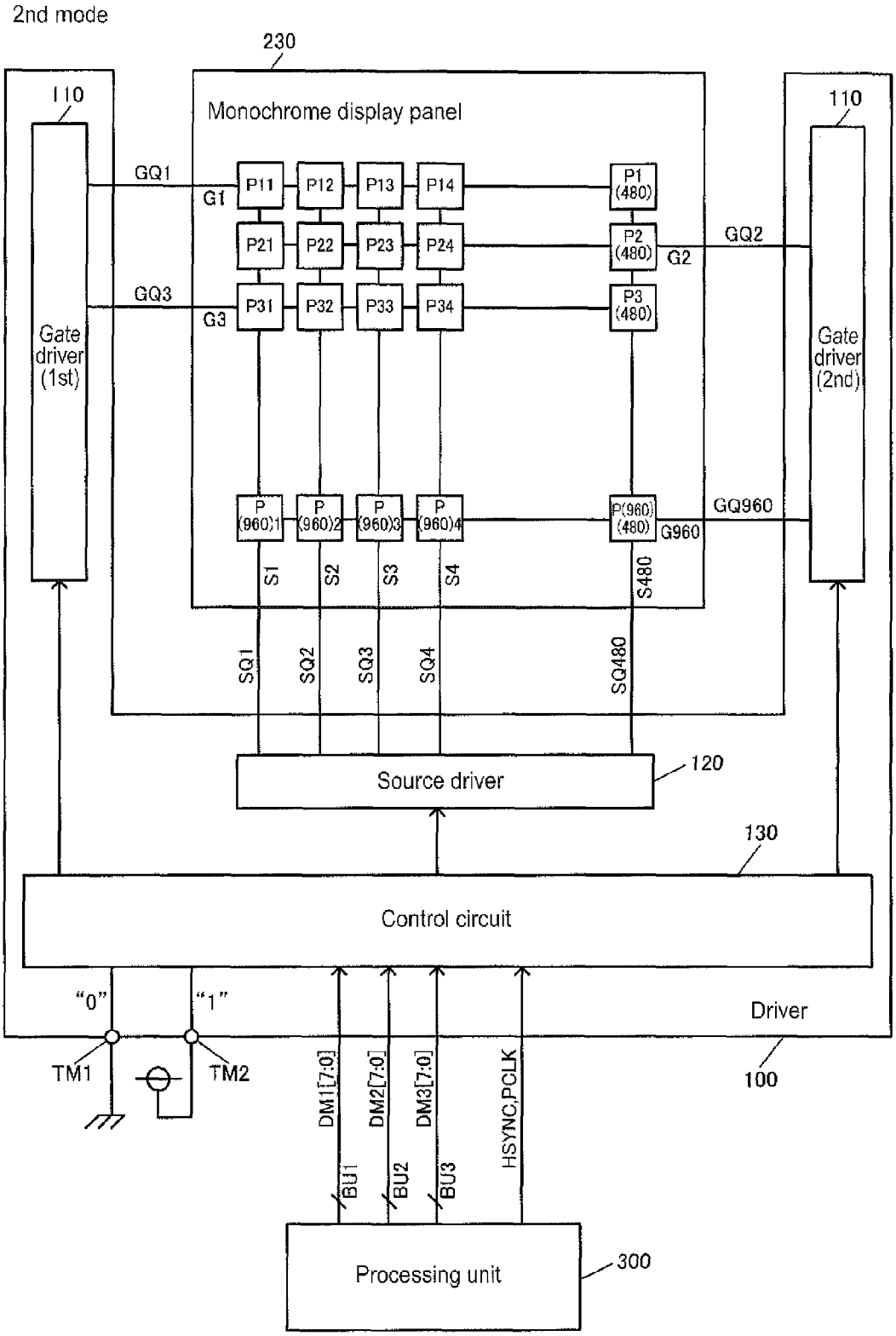
FIG. 6 shows an example of the connection configuration of the driver in the $2^{nd}$ mode.

FIG. 6 shows an example of the connection configuration of the driver in the $2^{nd}$ mode for driving the monochrome display panel shown in FIG. 3. Note that elements that are the same as elements already described above are indicated by the same reference signs, and explanation thereof is omitted.

The gate driver 110 drives the $1^{st}$ to $960^{th}$ gate lines (gate lines G1 to G960) of the monochrome display panel 230 by using the $1^{st}$ to $960^{th}$ gate drive signals (gate drive signals GQ1 to GQ960).

As described above with reference to FIG. 3, the monochrome display panel 230 is a panel in which one horizontal scan line is composed of one gate line. The reference signs indicating the pixels are the same as in FIG. 5.

The processing unit 300 outputs pieces of monochrome image data DM1[7:0], DM2[7:0], and DM3[7:0] to the $1^{st}$ bus BU1, the $2^{nd}$ bus BU2, and the $3^{rd}$ bus BU3, respectively. Thus, pieces of image data for three horizontal scan lines are input within one horizontal scan period. Each piece of gradation data has 8 bits per pixel for example, and, in total, 24 bits for the three horizontal scan lines. The control circuit 130 receives the pieces of image data (24 bits in total) in parallel.

In the $2^{nd}$ mode, the gate driver 110 drives the $j^{th}$ to $(j+2)^{th}$ gate lines (gate lines Gj to Gj+2) in each horizontal scan period (j changes for each horizontal scan period in the following manner: 1, 4, 7, . . . , 958). Then, in the horizontal scan period, the source driver 120 drives the pixels connected to the $j^{th}$ to $(j+2)^{th}$ gate lines (gate lines Gj to Gj+2) according to the pieces of monochrome image data DM1[7:0], DM2[7:0], and DM3[7:0] for the three horizontal scan lines. For example, in the $1^{st}$ horizontal scan period for driving the $1^{st}$ to $3^{rd}$ horizontal scan lines, the $1^{st}$ to $3^{rd}$ gate lines (gate lines G1 to G3) are selected (j=1). Then, the gradation voltages corresponding to the pieces of image data DM1[7:0], DM2[7:0], and DM3[7:0] are written into the pixels P11 to P1(480), P21 to P2(480), and P31 to P3(480), respectively.

As described above, in the $2^{nd}$ mode, three horizontal scan lines are rendered in each horizontal scan period. Therefore, the size of a one-frame image is 480×960, and thus the $2^{nd}$ mode realizes tree times the size (i.e., the number of the horizontal scan lines) of a color display panel. Also, as described below, the $2^{nd}$ mode reduces the input data rate compared to known methods for monochrome display, thereby reducing the power consumption. Note that the period from the falling edge of a horizontal synchronization signal to the subsequent falling edge thereof ("HP" in FIG. 11 and "hp" in FIG. 12) is referred to as "horizontal scan period", regardless of the number of horizontal scan lines to be rendered.

In the above description, it is assumed that the number of the outputs from the driver 100 is the same as the size (i.e. the number of the horizontal scan lines) of the monochrome display panel 230. However, the invention should not be limited in this way. In other words, the size of the monochrome display panel 230 may be q×m. The gate driver 110 may drive the $1^{st}$ to $m^{th}$ gate lines by using the $1^{st}$ gate to $m^{th}$ gate drive signals from among the $1^{st}$ to $p^{th}$ gate drive signals ($p \geq m$). In terms of the relationship with the size q×(n/3) of the color display panel 210, $p \geq n \geq m$ is satisfied. In the example shown in FIG. 6, m=n=p=960 and q=480.

In other words using p and m, in the $3^{rd}$ mode, the number of the horizontal scan lines of the monochrome display panel 220 is $m \leq p/3$ where p denotes the number of the gate drive signals (e.g., when p=960, $m \leq 320$ is satisfied). This is the same condition as in the color display in the $1^{st}$ mode. In the 2 mode on the other hand, the number of the horizontal scan lines of the monochrome display panel 220 is increased to m>p/3 (e.g., when p=960, $320 < m \leq 960$ is satisfied).

The embodiment above is described based on the case of "entire driving", in which q source lines are driven by q source drive signals. However, the invention should not be limited in this way. For example, "partial driving" may be realized when a RAM (not depicted in the drawings) for storing the display data is provided. In other words, q source lines may be driven by q' source drive signals (q>q'), so that only some of the pixels of the display panel are driven.

3. Details of Operation 3.1. $1^{st}$ Mode

Next, a detailed description is provided to the operation of the driver 100 in the $1^{st}$ to $3^{rd}$ modes.

Figure 7:
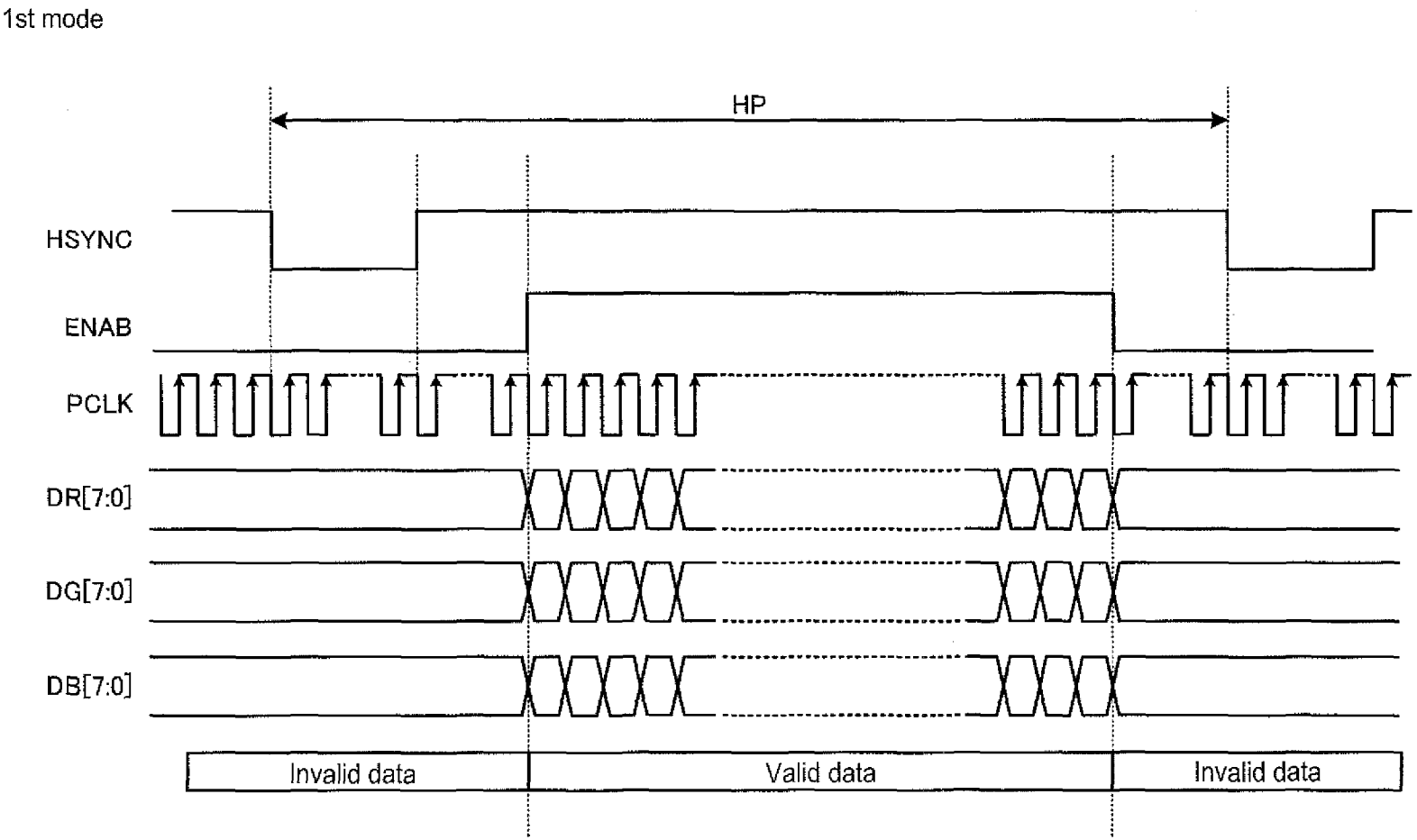
FIG. 7 is a timing chart showing operation for image data reading performed in the $1^{st}$ mode.

FIG. 7 is a timing chart showing operation for image data reading performed in the $1^{st}$ mode.

The period from a falling edge of the horizontal synchronization signal HSYNC to the subsequent falling edge thereof is referred to as horizontal scan period HP. The enable signal ENAB is activated during the period for which the processer 300 outputs valid image data, and the control circuit 130 reads the image data during this period. The control circuit 130 latches the pieces of image data DR[7:0], DG[7:0], and DB[7:0] at the rising edge of the clock signal PCLK. In other words, the control circuit 130 latches pieces of gradation data for three pixels corresponding to the RGB colors (24 bits in total) at one rising edge of the clock signal PCLK. Through the horizontal scan period HP, the control circuit 130 latches pieces of image data for one horizontal scan line (i.e., for 480×3 pixels).

Figure 8:
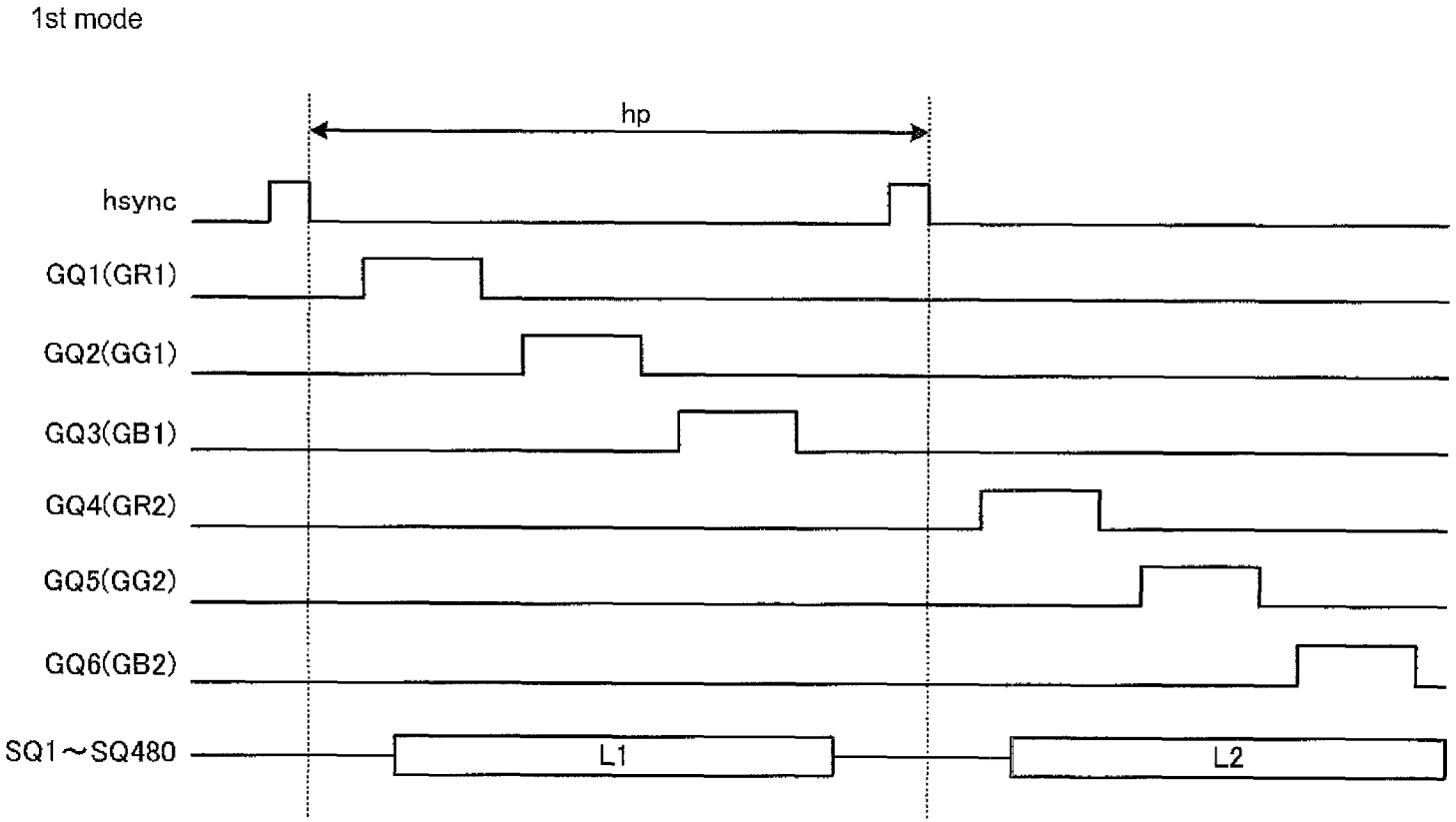
FIG. 8 is a timing chart showing operation for driving performed in the $1^{st}$ mode.

FIG. 8 is a timing chart showing operation for image data reading performed in the $1^{st}$ mode.

The horizontal synchronization signal hsync is an internal signal of the driver 100, generated by the control circuit 130. The period from a falling edge of the horizontal synchronization signal hsync to the subsequent falling edge thereof is referred to as the horizontal scan period. In the $1^{st}$ mode, the gate driver 110 sequentially selects the $i^{th}$ to $(i+2)^{th}$ gate lines in the horizontal scan period hp. Then, the source driver 120 sequentially drives the source lines S1 to 9480 according to the respective pieces of color image data DR[7:0], DG[7:0], and DB[7:0] for one horizontal scan line respectively corresponding to the $1^{st}$ to $3^{rd}$ colors (RGB). For example, in the $1^{st}$ horizontal scan period (i=1), the gate driver 110 first activates the gate drive signal GQ1 and selects the $1^{st}$ gate line GR1, next activates the gate drive signal GQ2 and selects the $2^{nd}$ gate line GG1, and then activates the gate drive signal GQ3 and selects the $3^{rd}$ gate line GB1. In synchronization with the timing of driving the gate lines, the source driver 120 sequentially outputs, to the source lines, the gradation voltage corresponding to the R color, the gradation voltage corresponding to the G color, and the gradation voltage corresponding to the B color, for the $1^{st}$ horizontal scan line L1. Similarly, in the subsequent $2^{nd}$ horizontal scan period (i=4), the $4^{th}$ to $6^{th}$ gate lines (gate lines GR2, GG2, and GB2) are sequentially selected, and the gradation voltages for the $2^{nd}$ horizontal scan line L2, corresponding to the RGB colors, are sequentially output to the source lines.

As described above, in the $1^{st}$ mode, one horizontal scan line is displayed by driving three gate lines for the R, G, and B colors in one horizontal scan period hp, and thus color display of frames each having a size of 480×320 can be performed.

3.2. $3^{rd}$ Mode

Figure 9:
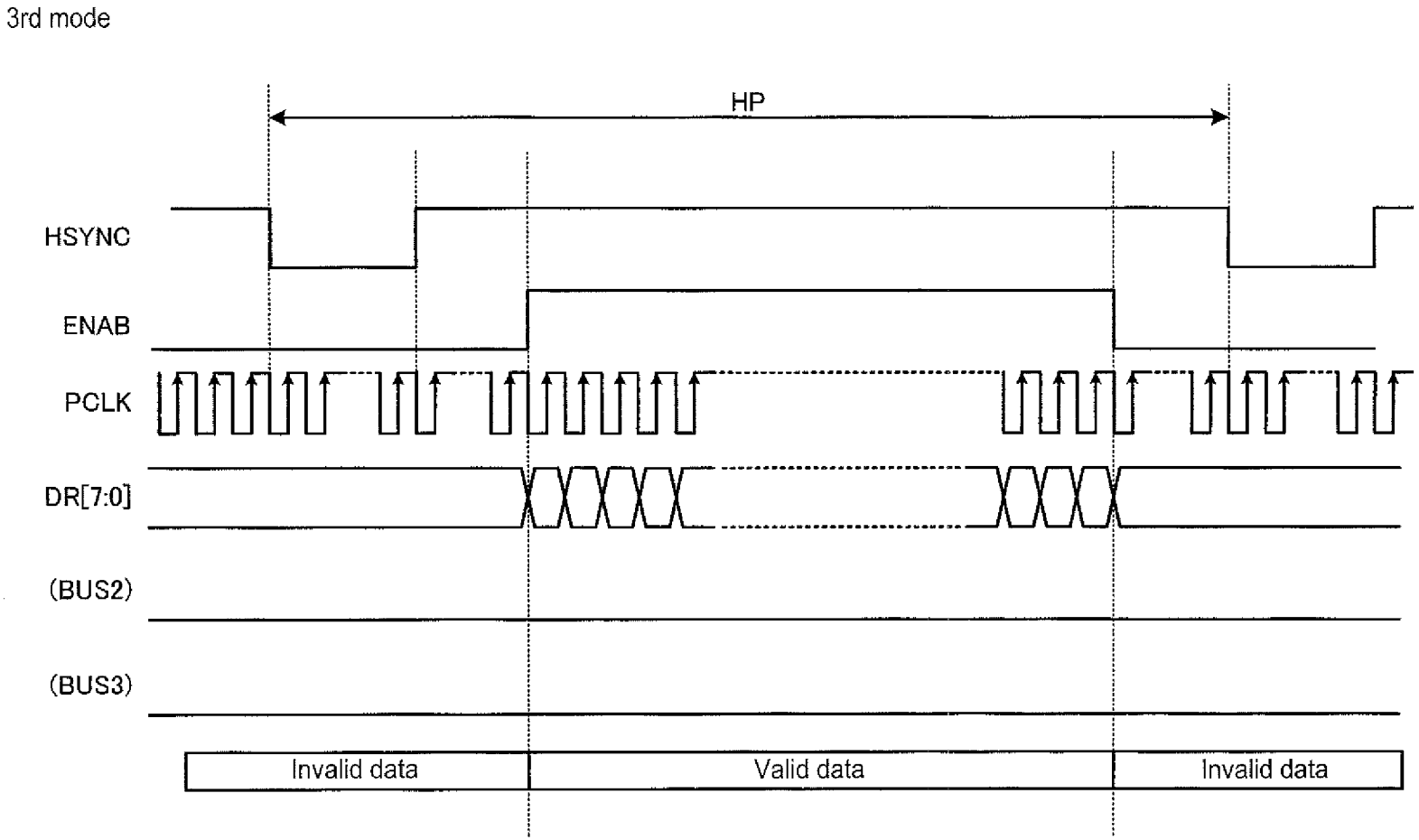
FIG. 9 is a timing chart showing operation for image data reading performed in the $3^{rd}$ mode.

FIG. 9 is a timing chart showing operation for image data reading performed in the $3^{rd}$ mode.

The control circuit 130 latches the image data DM[7:0] at a rising edge of the clock signal PCLK. In other words, the control circuit 130 latches the piece of gradation data (8 bits) for one monochrome pixel at one rising edge of the clock signal PCLK. Through the horizontal scan period HP, the control circuit 130 latches pieces of image data for one horizontal scan line (i.e. for 480 pixels).

Figure 10:
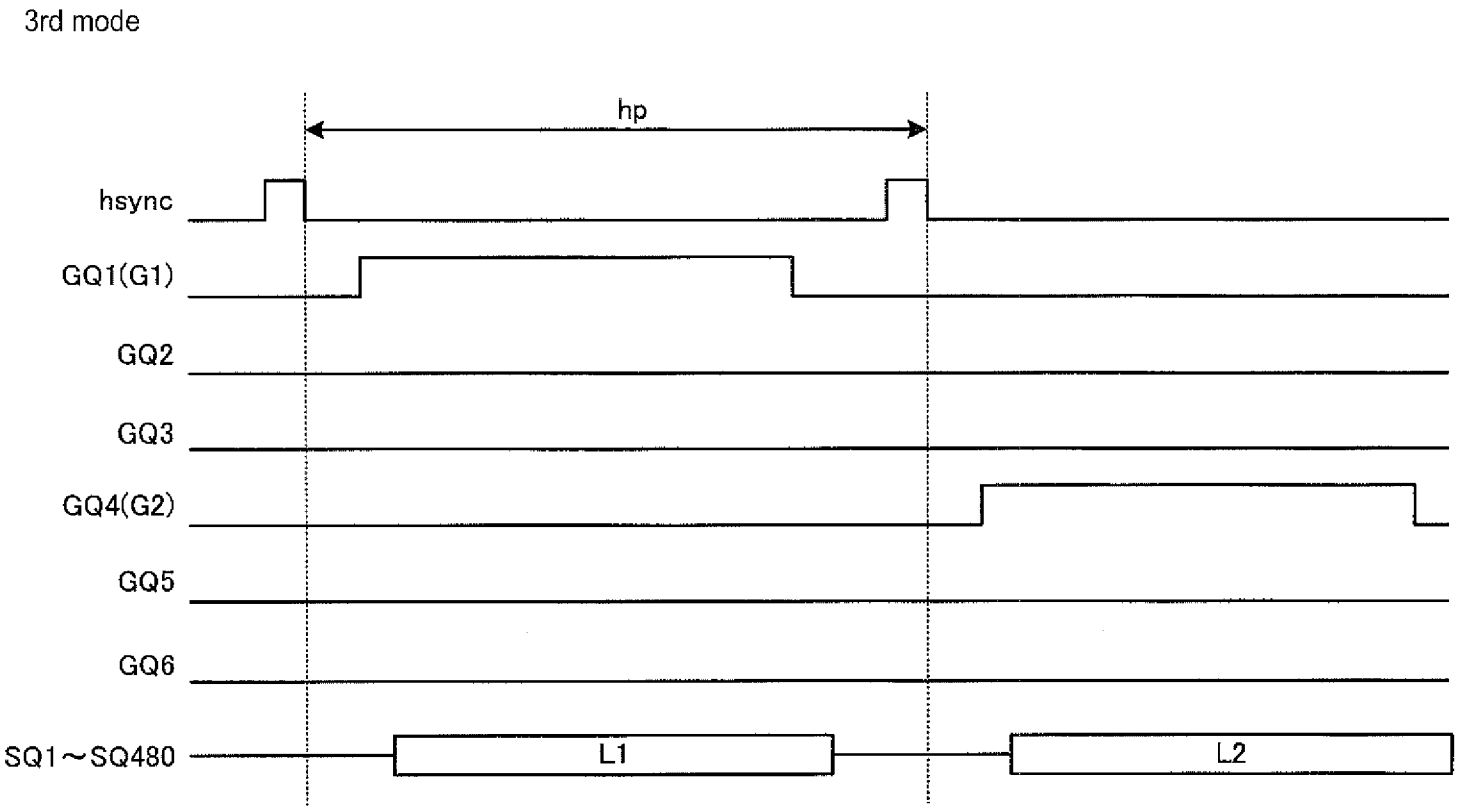
FIG. 10 is a timing chart showing driving performed in the $3^{rd}$ mode.

FIG. 10 is a timing chart showing operation for image data reading performed in the $3^{rd}$ mode.

In the $3^{rd}$ mode, the gate driver 110 selects the $k^{th}$ gate line in the horizontal scan period hp. Then, the source driver 120 drives the source lines S1 to S480 according to the monochrome image data DM[7:0] for the $k^{th}$ horizontal scan line. For example, in the $1^{st}$ horizontal scan period (k=1), the gate drive signal GQ1 is activated and the $1^{st}$ gate line G1 is selected, and the monochrome gradation voltages for the $1^{st}$ horizontal scan line L1 are output to the source lines. Similarly, in the subsequent $2^{nd}$ horizontal scan period (k=2), the $2^{nd}$ gate line G2 is selected, and the monochrome gradation voltages for the $2^{nd}$ horizontal scan line L2 are output to the source lines.

As described above, in the $3^{rd}$ mode, one horizontal scan line is displayed by driving one gate line in one horizontal scan period hp, and thus monochrome display of frames each having a size of 480×320 can be performed.

3.3. $2^{nd}$ Mode

Figure 11:
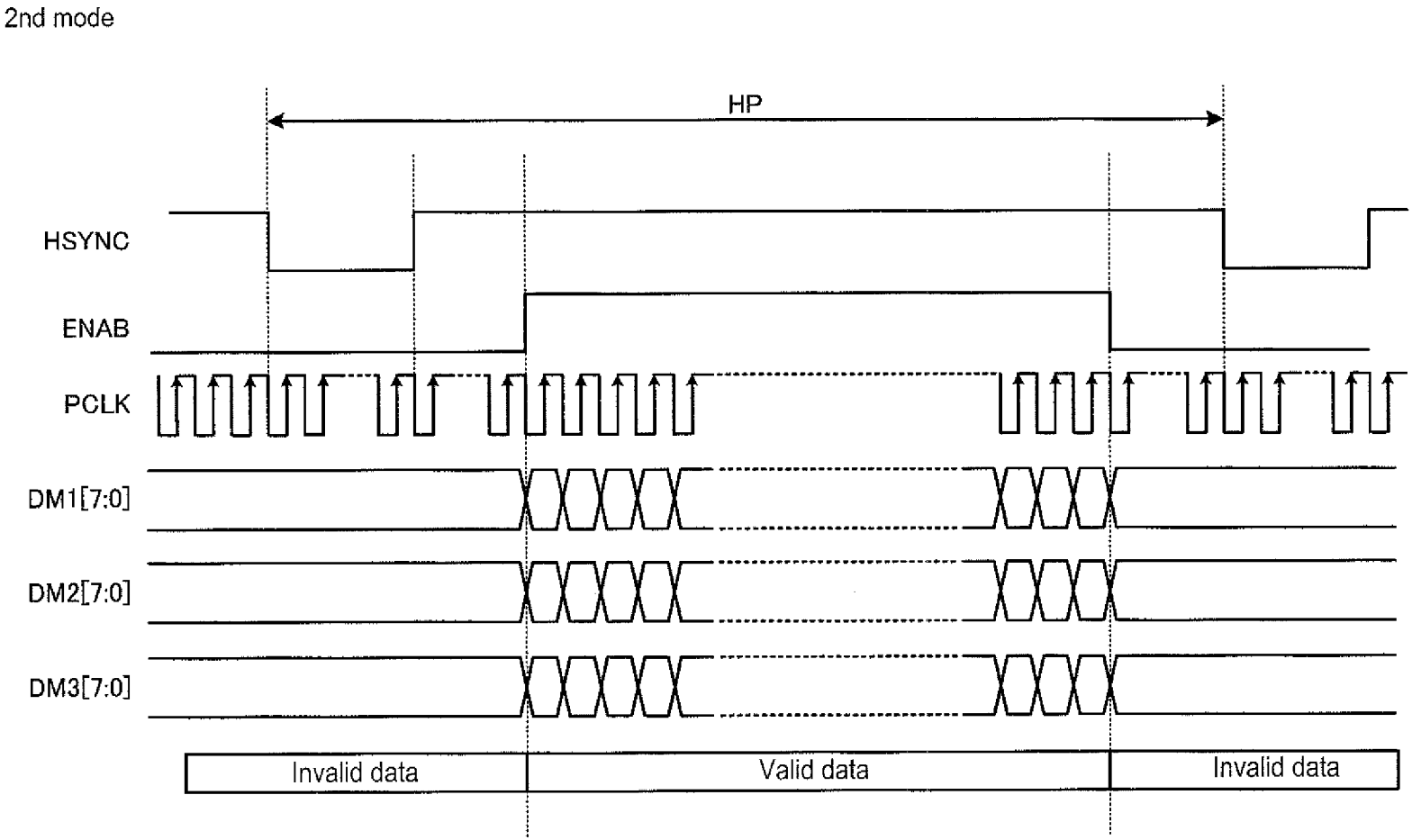
FIG. 11 is a timing chart showing operation for image data reading performed in the $2^{nd}$ mode.

FIG. 11 is a timing chart showing operation for image data reading performed in the $2^{nd}$ mode.

The control circuit 130 latches the pieces of image data DM1[7:0], DM2[7:0], and DM3[7:0] at a rising edge of the clock signal PCLK. In other words, the control circuit 130 latches the pieces of gradation data for three monochrome pixels (24 bits in total) at one rising edge of the clock signal PCLK. Through the horizontal scan period HP, the control circuit 130 latches pieces of image data for three horizontal scan lines (i.e., for 480×3 pixels).

Figure 12:
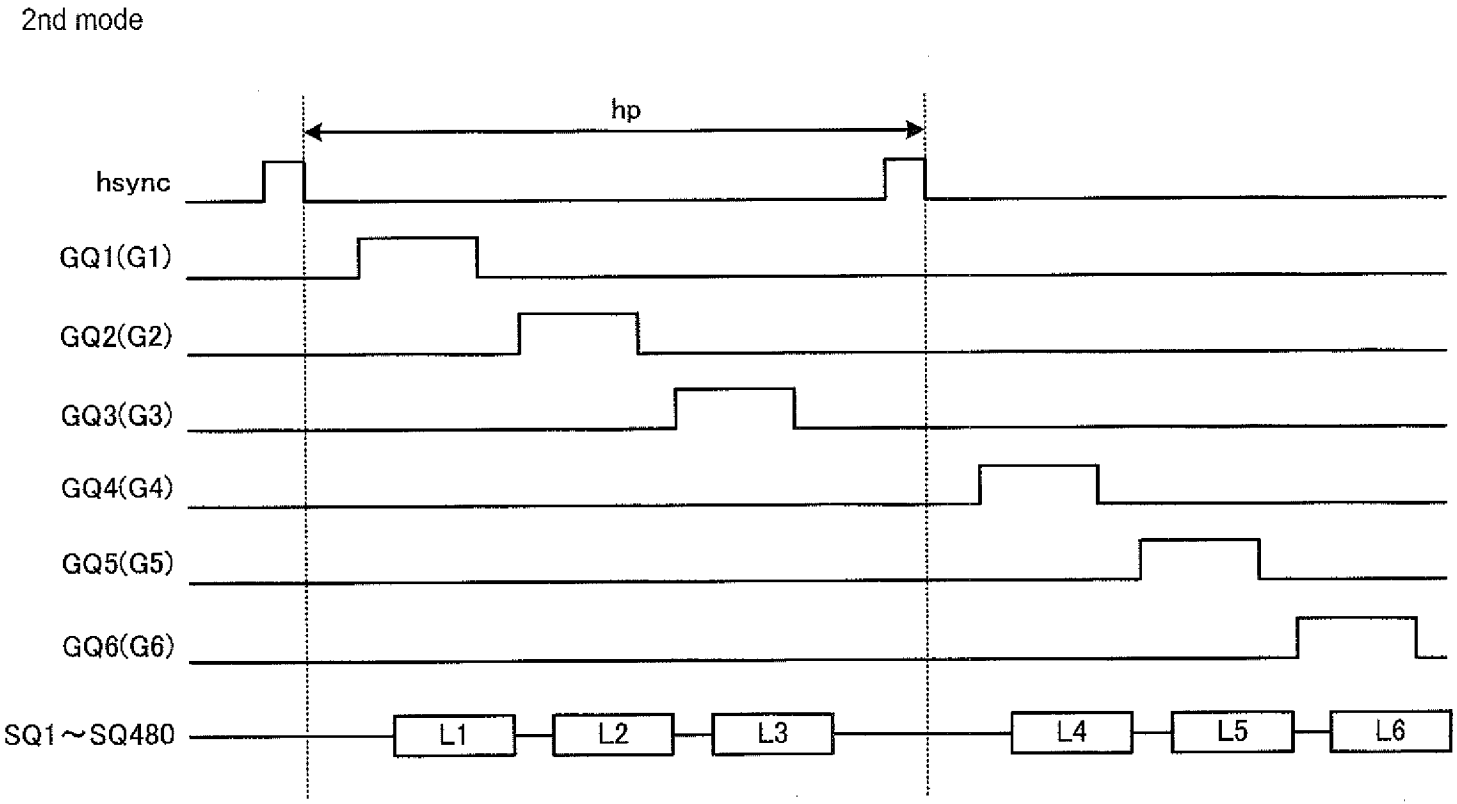
FIG. 12 is a timing chart showing operation for driving performed in the $2^{nd}$ mode.

FIG. 12 is a timing chart showing operation for driving performed in the $2^{nd}$ mode.

In the $2^{nd}$ mode, the gate driver 110 sequentially selects the $j^{th}$ to $(j+2)^{th}$ gate lines in the horizontal scan period hp. Then, the source driver 120 sequentially drives the source lines S1 to S480 according to the respective pieces of monochrome image data DM1[7:0], DM2[7:0], and DM3[7:0] for the $1^{st}$ to $3^{rd}$ horizontal scan lines. For example, in the $1^{st}$ horizontal scan period (j=1): first, the gate drive signal GQ1 is activated and the $1^{st}$ gate line G1 is selected, and the gradation voltage for the $1^{st}$ horizontal scan line L1 is output to the source lines; next, the gate drive signal GQ2 is activated and the $2^{nd}$ gate line G2 is selected, and the gradation voltage for the $2^{nd}$ horizontal scan line L2 is output to the source lines; and then the gate drive signal GQ3 is activated and the $3^{rd}$ gate line G3 is selected, and the gradation voltage for the $3^{rd}$ horizontal scan line L3 is output to the source lines. Similarly, in the subsequent $2^{nd}$ horizontal scan period (j=4), the $4^{th}$ to $6^{th}$ gate lines (gate lines G4 to G6) are sequentially selected, and the gradation voltages for the $4^{th}$ to $6^{th}$ horizontal scan lines (horizontal scan lines L4 to L6) are output to the source lines.

As described above, in the $2^{nd}$ mode, three horizontal scan lines are displayed by driving three gate lines in one horizontal scan period hp, and thus monochrome display of frames each having a size of 480×960 can be performed.

Also, the $2^{nd}$ mode reduces the input data rate compared to known monochrome display methods by which one horizontal scan line is displayed in one horizontal scan period. For example, in the case of displaying monochrome images having a size of 480×960 at a refresh rate of 60 Hz, the input data rate and the processing frequency according to known monochrome display methods are approximately 40 MHz. In the embodiment, three horizontal scan lines are displayed in one horizontal scan period, and accordingly the input data rate and the processing frequency are reduced to be ⅓, i.e., approximately 13 MHz. This reduction in operating frequency leads to the reduction in power consumption.

4. Technique of Setting Modes

Next, a description is given to techniques of setting the $1^{st}$ to $3^{rd}$ modes.

As shown in FIG. 4 through FIG. 6, the driver 100 has mode setting terminals TM1 and TM2. The control circuit 130 sets one of the $1^{st}$ to $3^{rd}$ modes according to the voltage levels set to the mode setting terminals TM1 and TM2.

Specifically, on the circuit board on which the driver 100 is mounted, the mode setting terminals TM1 and TM2 are connected to a node at the $1^{et}$ voltage level (e.g., ground voltage) or a node at the $2^{nd}$ voltage level (e.g., power supply voltage). The control circuit 130 sets "0" to the setting value of the mode setting terminal at the $1^{st}$ voltage level, and "1" to the setting value of the mode setting terminal at the $2^{nd}$ voltage level.

For example, when the setting value of the mode setting terminals TM1 and TM2 is "00", the $1^{st}$ mode for driving the color display panel 210 having a size of 480×320 is set. When the setting value is "01", the $2^{nd}$ mode for driving the monochrome display panel 230 having a size of 480×960 is set. When the setting value is "11", the $3^{rd}$ mode for driving the monochrome display panel 220 having a size of 480×320 is set.

Note that the technique of setting the mode is not limited to the above-described technique, and the $1^{st}$ to $3^{rd}$ modes may be set based on a mode setting command from the processing unit 300 (host controller). If this is the case, the processing unit 300 issues a command specifying the mode, and the control circuit 130 sets the mode by acquiring the mode setting value from the command.

By the above-described mode setting technique, the driver 100 according to the embodiment is capable of switch between the three modes depending on the display panel and the way of driving. In other words, the driver 100 is capable of switching between the mode for driving a color display panel and the two modes for driving a monochrome display panel (i.e., the mode for driving one horizontal scan line in one horizontal scan period, and the mode for driving three horizontal scan lines in one horizontal scan period).

Note that when the number of bits of the image data supplied from the processing unit 300 is constant (e.g., always 8 bits for one pixel as shown in FIG. 4, FIG. 6, etc.), it is not necessary to provide both the $1^{st}$ mode and the $2^{nd}$ mode. When the number of bits of image data is not constant (e.g., 6 bits for one pixel in color and 4 bits for one pixel in monochrome), it is necessary to perform processing within the driver to expand the data to have the same length (e.g., 8 bits), and therefore the mode switching is required.

5. Electronic Apparatus

Figure 13:
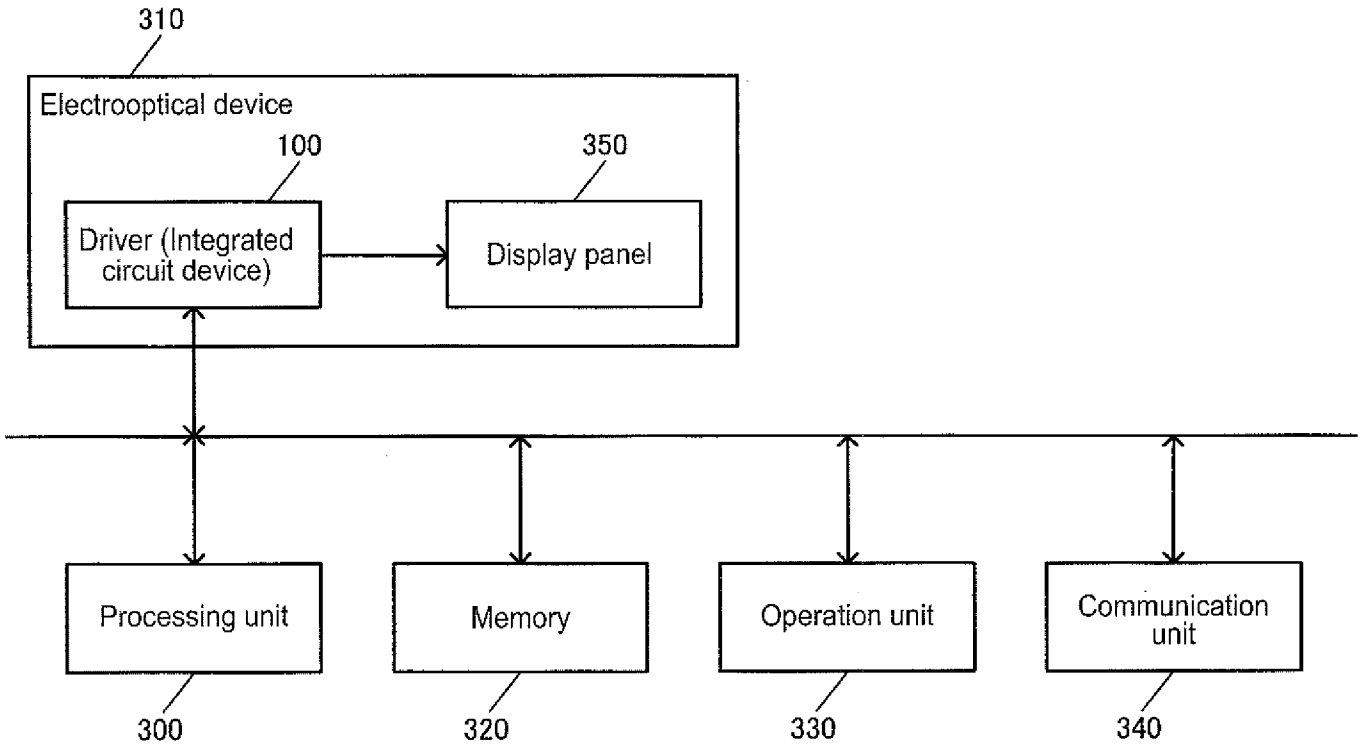
FIG. 13 shows an example of the configuration of an electronic apparatus.

FIG. 13 shows an example of the configuration of an electronic apparatus to which the driver 100 according to the embodiment can be applied.

The electronic apparatus includes a processing unit 300, an electro-optical device 310, a memory 320, an operation unit 330, and a communication unit 340. The electro-optical device 310 includes a driver 100 and a display panel 350. The display panel 350 is a color display panel or a monochrome display panel.

The electronic apparatus is, for example, a display device such as a meter installed in a car, a display apparatus such as a TV, a mobile device such as a smart phone, a portable gaming device, and a car navigation system.

The processing unit 300 includes a processor such as a CPU, an ASIC for image processing, and a DSP, and performs various kinds of processing and controls each unit. For example, the processing unit 300 reads image data from the memory 320 or receives image data via the communication unit 340, and causes the electro-optical device 310 to display the image data. The memory 320 includes RAM or ROM for example, and serves as a working memory for the processing unit 300, or stores various kinds of data. The operation unit 330 includes, for example, a touch panel, a button and a keyboard, and receives operational information from the user. The communication unit 340 is, for example, an USB or an interface for wired LAN, optical communications, wireless LAN, mobile telecommunications (e.g. 3G and 4G), etc., and exchanges various kinds of data and control information with an external device.

Note that although the embodiment has been described above in detail, it should be apparent to a person skilled in the art that various modifications that do not stray substantially from the novelty and effects of the invention are possible. Accordingly, these modifications are all intended to be encompassed in the scope of the invention. For example, in the specification and the drawings, terms written together with different terms that are more widely interpreted or have the same meaning in at least one instance can be replaced with those different terms in all cases in the specification or the drawings. Also, all combinations of the embodiment and the modifications are also included in the scope of the invention. Also, the configurations, operations, and the like of the display panel, the driver, the processing unit, the electro-optical device, and the electronic apparatus are not limited to the description given in the embodiment, and can be implemented with various modifications.

What is claimed is:

1. A driving method for use by a driver, the driver controlling a plurality of gate lines, the method comprising:

in a $1^{st}$ case, which is a case of driving a color display panel, the color display panel displaying a plurality of color horizontal scan lines, in which one horizontal scan line is composed of three gate lines corresponding to $1^{st}$ to $3^{rd}$ colors, receiving pieces of color image data corresponding to the $1^{st}$ to $3^{rd}$ colors in parallel; and driving, in a horizontal scan period, pixels connected to $i^{th}$ to $(i+2)^{th}$ gate lines corresponding to the horizontal scan period from among $1^{st}$ to $n^{th}$ gate lines of the color display panel according to the pieces of color image data corresponding to the $1^{st}$ to $3^{rd}$ colors, where n is a natural number no less than 3, and i=1, 4, 7, . . . , n−2, and in a $2^{nd}$ case, which is a case of driving a monochrome display panel, the monochrome display panel displaying a plurality of monochrome horizontal scan lines, in which one horizontal scan line is composed of one gate line, receiving pieces of monochrome image data for three different horizontal scan lines in parallel; and driving, in a horizontal scan period, pixels connected to $i^{th}$ to $(j+2)^{th}$ gate lines corresponding to the horizontal scan period from among $1^{st}$ to $m^{th}$ gate lines of the monochrome display panel according to the pieces of monochrome image data for the three different horizontal scan lines of the monochrome display panel, where m is a natural number no less than 3, and j=1, 4, 7, . . . , m−2.

2. The driving method according to claim 1, wherein, in the $2^{nd}$ case, which is the case of driving the monochrome display panel, in the horizontal scan period, the $j^{th}$ to $(j+2)^{th}$ gate lines are sequentially selected, and source lines of the monochrome display panel are sequentially driven according to the respective pieces of monochrome image data for $1^{st}$ to $3^{rd}$ horizontal scan lines from among the three horizontal scan lines.

3. The driving method according to claim 1, wherein, in the $1^{st}$ case, which is the case of driving the color display panel, in the horizontal scan period, the $i^{th}$ to $(i+2)^{th}$ gate lines are sequentially selected, and source lines of the color display panel are sequentially driven according to the respective pieces of color image data corresponding to the $1^{st}$ to $3^{rd}$ colors.

4. The driving method according to claim 1 further comprising:

setting one of $1^{st}$ to $3^{rd}$ modes;

when the $1^{st}$ mode is set, performing operation for the $1^{st}$ case, which is the case of driving the color display panel;

when the $2^{nd}$ mode is set, performing operation for the $2^{nd}$ case, which is the case of driving the monochrome display panel; and when the $3^{rd}$ mode is set, receiving monochrome image data for one horizontal scan line; and driving, in a horizontal scan period, pixels connected to a $k^{th}$ gate line from among the $1^{st}$ to $m^{th}$ gate lines of the monochrome display panel according to the monochrome image data for the one horizontal scan line, where k is a natural number no greater than m.

5. The driving method according to claim 4, wherein the $1^{st}$ to $3^{rd}$ modes are set according to a voltage level that is set to a mode setting terminal, or a mode setting command that is received from a host controller.

6. The driving method according to claim 1, wherein, in the $2^{nd}$ case, which is the case of driving the monochrome display panel, $1^{st}$ to $m^{th}$ gate drive signals from among $1^{st}$ to $p^{th}$ gate drive signals are output to the $1^{st}$ to $m^{th}$ gate lines, where p is a natural number no less than m, and m>p/3.

7. A driver comprising:

a gate driver;

a source driver; and a control circuit that controls a plurality of gate lines through controlling the gate driver and the source driver, wherein, in a $1^{st}$ case, which is a case of driving a color display panel, the color display panel displaying a plurality of color horizontal scan lines, in which one horizontal scan line is composed of three gate lines corresponding to $1^{st}$ to $3^{rd}$ colors, the control circuit receives pieces of color image data corresponding to the $1^{st}$ to $3^{rd}$ colors in parallel, the gate driver, in a horizontal scan period, drives $i^{th}$ to $(i+2)^{th}$ gate lines corresponding to the horizontal scan period from among $1^{st}$ to $n^{th}$ gate lines of the color display panel, where n is a natural number no less than 3, and i=1, 4, 7, . . . n−2, and the source driver, in the horizontal scan period, drives pixels connected to the $i^{th}$ to $(i+2)^{th}$ gate lines according to the pieces of color image data corresponding to the $1^{st}$ to $3^{rd}$ colors, and in a $2^{nd}$ case, which is a case of driving a monochrome display panel, the monochrome display panel displaying a plurality of monochrome horizontal scan lines, in which one horizontal scan line is composed of one gate line, the control circuit receives pieces of monochrome image data for three different horizontal scan lines in parallel, the gate driver, in the horizontal scan period, drives $j^{th}$ to $(j+2)^{th}$ gate lines corresponding to the horizontal scan period from among $1^{st}$ to $m^{th}$ gate lines of the monochrome display panel, where m is a natural number no less than 3, and j=1, 4, 7, . . . , m−2, and the source driver, in the horizontal scan period, drives pixels connected to the $j^{th}$ to $(j+2)^{th}$ gate lines according to the pieces of monochrome image data for the three different horizontal scan lines.

8. The driver according to claim 7, wherein the control circuit sets one of $1^{st}$ to $3^{rd}$ modes, when the $1^{st}$ mode is set, the control circuit, the gate driver, and the source driver perform operation for the $1^{st}$ case, which is the case of driving the color display panel, when the $2^{nd}$ mode is set, the control circuit, the gate driver, and the source driver perform operation for the $2^{nd}$ case, which is the case of driving the monochrome display panel, and when the $3^{rd}$ mode is set, the control circuit receives monochrome image data for one horizontal scan line, the gate driver, in a horizontal scan period, drives a $k^{th}$ gate line from among the $1^{st}$ to $m^{th}$ gate lines of the monochrome display panel, where k is a natural number no greater than m, and the source driver, in the horizontal scan period, drives pixels connected to the $k^{th}$ gate line according to the monochrome image data for the one horizontal scan line.

9. The driver according to claim 8, wherein the control circuit sets the $1^{st}$ to $3^{rd}$ modes according to a voltage level that is set to a mode setting terminal, or a mode setting command that is received from a host controller.

10. An electro-optical device comprising:

the driver according to claim 9; and the color display panel or the monochrome display panel.

11. An electro-optical device comprising:

the driver according to claim 8; and the color display panel or the monochrome display panel.

12. An electronic apparatus comprising the driver according to claim 8.

13. The driver according to claim 7, wherein, in the $2^{nd}$ case, which is the case of driving the monochrome display panel, the gate driver sequentially selects the $j^{th}$ to $(j+2)^{th}$ gate lines in the horizontal scan period, and the source driver sequentially drives source lines of the monochrome display panel according to the respective pieces of monochrome image data for $1^{st}$ to $3^{rd}$ horizontal scan lines from among the three horizontal scan lines.

14. An electro-optical device comprising:

the driver according to claim 13; and the color display panel or the monochrome display panel.

15. The driver according to claim 7, wherein, in the $1^{st}$ case, which is the case of driving the color display panel the gate driver sequentially selects the $i^{th}$ to $(i+2)^{th}$ gate lines, and the source driver sequentially drives source lines of the color display panel according to the respective pieces of color image data corresponding to the $1^{st}$ to $3^{rd}$ colors.

16. An electro-optical device comprising:

the driver according to claim 15; and the color display panel or the monochrome display panel.

17. The driver according to claim 7, wherein, in the $2^{nd}$ case, which is the case of driving the monochrome display panel the gate driver outputs $1^{st}$ to $m^{th}$ gate drive signals from among $1^{st}$ to $p^{th}$ gate drive signals to the $1^{st}$ to $m^{th}$ gate lines, where p is a natural number no less than m, and m>p/3.

18. An electro-optical device comprising:

the driver according to claim 17; and the color display panel or the monochrome display panel.

19. An electro-optical device comprising:

the driver according to claim 7; and the color display panel or the monochrome display panel.

20. An electronic apparatus comprising the driver according to claim 7.

* * * * *